US008246140B2

(12) United States Patent
Maekawara et al.

(10) Patent No.: US 8,246,140 B2
(45) Date of Patent: Aug. 21, 2012

(54) CORRECTION METHOD OF FEEDING AMOUNT OF CONVEYANCE BELT AND INKJET RECORDING APPARATUS USING THE METHOD

(75) Inventors: Minoru Maekawara, Hino (JP); Yasushi Niizeki, Hachioji (JP); Masakazu Mori, Sagamihara (JP)

(73) Assignee: Konica Minolta IJ Technologies, Inc., Tokyo (JP)

( * ) Notice: Subject to any disclaimer, the term of this patent is extended or adjusted under 35 U.S.C. 154(b) by 237 days.

(21) Appl. No.: 12/766,082

(22) Filed: Apr. 23, 2010

(65) Prior Publication Data

US 2010/0277537 A1 Nov. 4, 2010

(30) Foreign Application Priority Data

May 1, 2009 (JP) ..... 2009-112221

(51) Int. Cl.
*B41J 29/393* (2006.01)

(52) U.S. Cl. ..... 347/19; 347/16; 347/115

(58) Field of Classification Search ..... 347/5, 9, 347/16, 19, 115
See application file for complete search history.

(56) References Cited

U.S. PATENT DOCUMENTS 5,648,809 A * 7/1997 Kato et al. ..... 347/115
6,353,481 B1 3/2002 Lee
7,083,251 B2 8/2006 Kang et al.
7,494,204 B2 2/2009 Otsuki
2006/0165442 A1 7/2006 Kobayashi et al.

FOREIGN PATENT DOCUMENTS

EP 1 447 230 A1 8/2004
JP 2003-11345 A 1/2003
JP 2003-11347 A 1/2003
JP 2004-115176 A 4/2004
JP 2005-305919 A 11/2005

OTHER PUBLICATIONS

Extended European Search Report (EESR) dated Oct. 13, 2011 (in English) in counterpart European Application No. 10160668.9.

* cited by examiner

*Primary Examiner* — Lam S Nguuyen
(74) *Attorney, Agent, or Firm* — Holtz, Holtz, Goodman & Chick, PC

(57) ABSTRACT

An inkjet recording apparatus includes: a control device that controls feeding of the conveyance belt so that a recording medium is conveyed at a pitch of a prescribed feeding amount in a feeding direction, and establishes an origin on the recording medium based on a detection of a starting point arranged on the conveyance belt, and controls driving of the inkjet head so that test dots of an amount equivalent to one round of the conveyance belt are printed on the recording medium at the pitch, from the origin; and a correction device that corrects the feeding amount of the conveyance belt to a corrected feeding amount corresponding to a feeding position of the conveyance belt based on the measurement results for an inputted printing space, wherein the control device causes an ink droplet to jet to the recording medium according to the corrected feeding amount.

14 Claims, 9 Drawing Sheets

CORRECTION METHOD OF FEEDING AMOUNT OF CONVEYANCE BELT AND INKJET RECORDING APPARATUS USING THE METHOD

This application is based on Japanese Patent Application No. 2009-112221 filed on May 1, 2009, which is incorporated hereinto by reference.

BACKGROUND OF THE INVENTION

The present invention relates to a correction method of a feeding amount of a conveyance belt and to an inkjet recording apparatus employing the correction method of a feeding amount of a conveyance belt.

As an inkjet recording apparatus wherein ink drops are jetted from an ink jet head on a recording medium to be printed, there has been known one wherein a recording medium is conveyed by a conveyance belt of an endless type that is trained about plural rollers.

This conveyance belt is usually formed to be in an endless form by combining both ends of a belt-shaped belt member to be in a serrated form, so that both ends may be aced and spliced. In this thermal fusion splicing, both end portions of the belt member are pressed while they are fused. Therefore, the spliced portion thus spliced receives heat and pressure in the case of splicing, and its physical properties are changed, resulting in the phenomena where hardness and thickness of the spliced portion are different from those of other potions of the conveyance belt.

When a recording medium is conveyed by the conveyance belt having this spliced portion, when the spliced portion touches a roller, a difference of an amount of elongation from other portions of the belt is caused, and therefore, a feeding amount of the conveyance belt is fluctuated, resulting in troubles that an amount of conveyance for a recording medium is fluctuated.

Incidentally, it is also possible to manufacture a conveyance belt in an endless type, which, however, is not preferable because the manufacturing cost is high.

As a method for solving the aforesaid troubles, there have been suggested a method to detect the spliced portion to avoid sending of a recording medium and image forming in the spliced portion (for example, see Unexamined Japanese Patent Application Publication No. 2004-115176) and a method to detect a speed of the conveyance belt from rotation of a roller and to control speed fluctuation of the conveyance belt in the case of image forming by correcting image forming timing in the case when a reference position on the conveyance belt passes through the bottom part of an inkjet head, based on the aforesaid detection (for example, see Unexamined Japanese Patent Publication No. 2005-305919). In addition, there have been suggested methods to detect sheet-feeding errors of the conveyance belt and to control sheet-feeding errors by correcting encoder pulse to drive motor based on the results of the aforesaid detection by detecting an amount of conveyance for a recording medium from rotations of a roller and by confirming banding (white streaks and black streaks) by printing of plural-colored test patterns (for example, see Unexamined Japanese Patent Application Publication No. 2003-11345 and Japanese Patent Application Publication No. 3876654).

However, in the method described in Unexamined Japanese Patent Application Publication No. 2004-115176, it was impossible to print on a recording medium, because a fluctuation of a feeding amount of a conveyance belt in the case when the spliced portion touches the upper portion of the roller has not been controlled. Further, in the case of the methods described in Unexamined Japanese Patent Publication Nos. 2005-305919 and 2003-11345, and Japanese Patent Publication No. 3876654, fluctuations of feeding amount caused by a difference of an amount of elongation of the aforesaid conveyance belt cannot be detected by rotation of the roller, although speed fluctuations of the conveyance belt or sheet feeding errors are controlled based on the detection of rotations of the roller. In other words, fluctuations of feeding amount caused by distributions of hardness and thicknesses represented by the spliced portion and the other portions have not been controlled, because a feeding amount of the conveyance belt and an amount of rotation of the roller are not necessarily the same.

The present invention has been achieved in view of the aforesaid situation, and its objective is to provide a method of correcting a feeding amount of the conveyance belt that can control fluctuations of a feeding amount caused by distributions of hardness and thickness of the conveyance belt, and to provide an inkjet recording apparatus.

SUMMARY OF THE INVENTION

An aspect of the invention is as follows.

A feeding amount correction method for the conveyance belt in an inkjet recording apparatus that jets an ink droplet to a recording medium from an inkjet head while conveying the recording medium supported on the conveyance belt by feeding of an endless conveyance belt for conducting printing, wherein there are provided a test printing process to print test dots equivalent in terms of an amount to one round of the conveyance belt at a pitch of the prescribed feeding amount, from an origin on the recording medium to be established when a starting point arranged on the conveyance belt is detected, while causing the conveyance belt to convey the recording medium in the feeding direction of the conveyance belt at the pitch of the prescribed feeding amount, a process of measuring an amount of conveyance that measures a printing space for the test dots printed in the test printing process, a correction process that corrects a feeding amount of the conveyance belt to the corrected feeding amount corresponding to the conveyance position of the conveyance belt, based on results of the measurement in the aforesaid process of measuring an amount of conveyance, and an ordinary printing process that conducts printing on the recording medium, while feeding the conveyance belt with the aforesaid corrected feeding amount that results from the correction in the aforesaid correction process.

Another aspect of the invention is as follows.

An inkjet recording apparatus that conducts printing by discharging an ink droplet to the aforesaid recording medium from an inkjet head while causing an endless conveyance belt to convey the recording medium supported on the conveyance belt, wherein there are provided a control device that controls feeding of the conveyance belt so that the aforesaid recording medium may be conveyed at a pitch of the prescribed feeding amount in the direction of feeding the conveyance belt, and establishes an origin on the recording medium based on the detection of a starting point arranged on the conveyance belt, and controls driving of the inkjet head so that print test dots equivalent in terms of an amount to one round of the conveyance belt may be printed on the recording medium at the pitch of the prescribed feeding amount, from the origin, an input device where results of the measurement for the aforesaid printing space for the test dots are inputted, and a correction device that corrects a feeding amount of the conveyance belt to a corrected feeding amount corresponding to the position of feeding the conveyance belt, based on results of the measurement for the inputted printing space, and the control device causes an ink droplet to break out to the recording medium from the inkjet head while feeding the conveyance belt according to the corrected feeding amount corrected by the correction device.

Figure 5A:
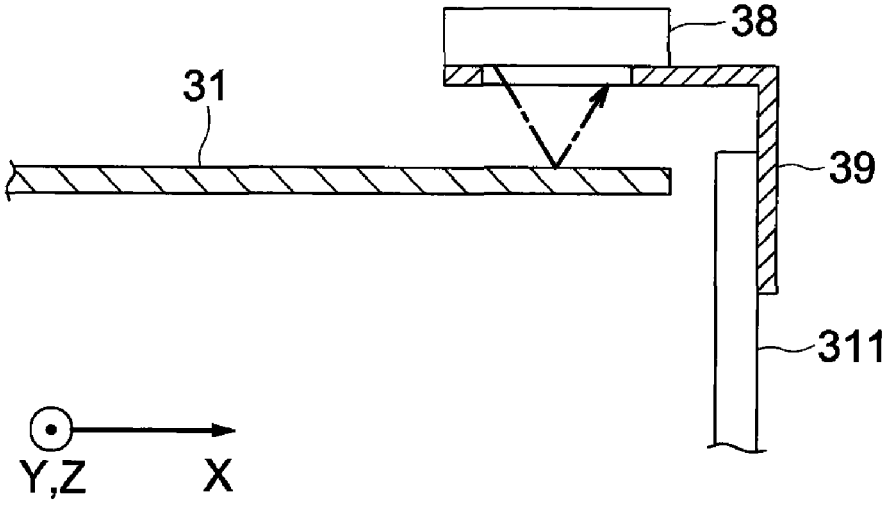
Figure 5B:
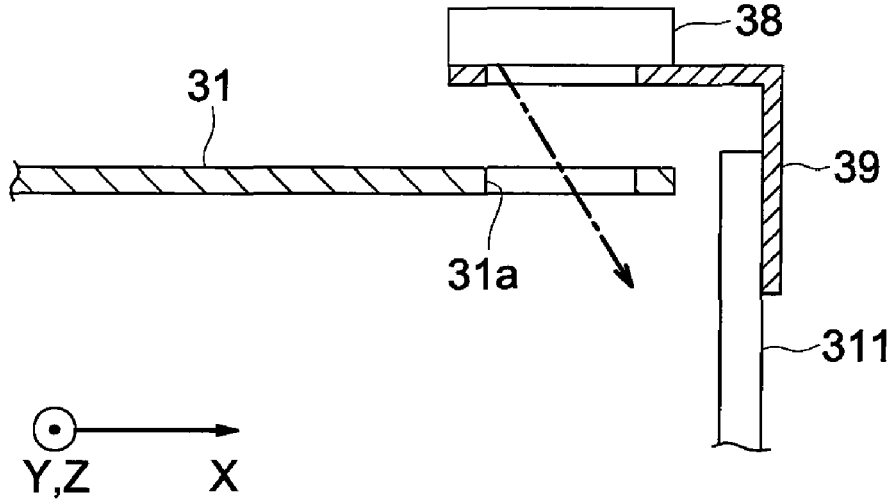

Each of FIGS. 5A and 5B is a diagram for illustrating detecting operations for a detection sensor.

Figure 6:
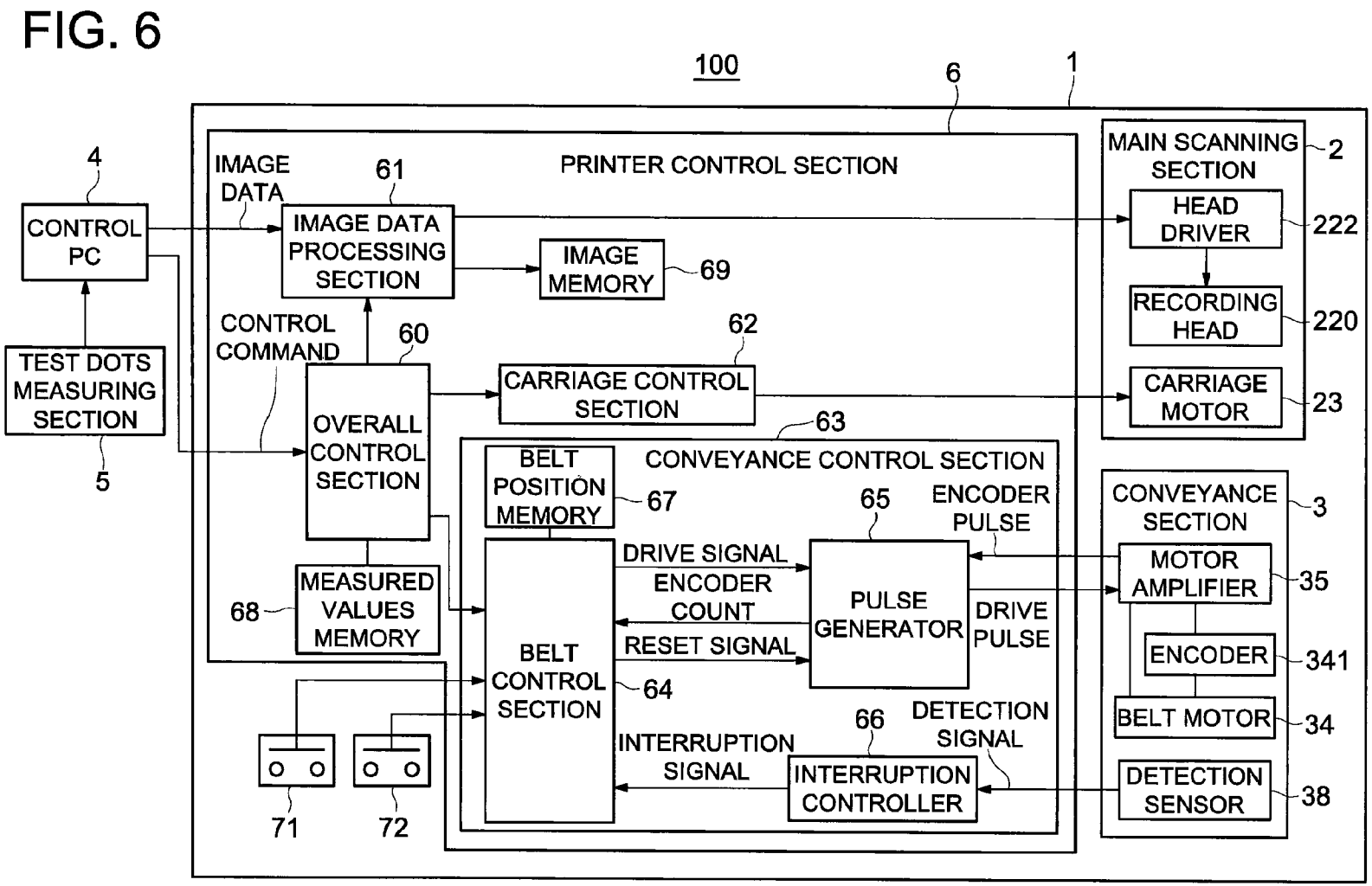

FIG. 6 is a block diagram showing the structure of control for the inkjet recording apparatus.

Figure 7:
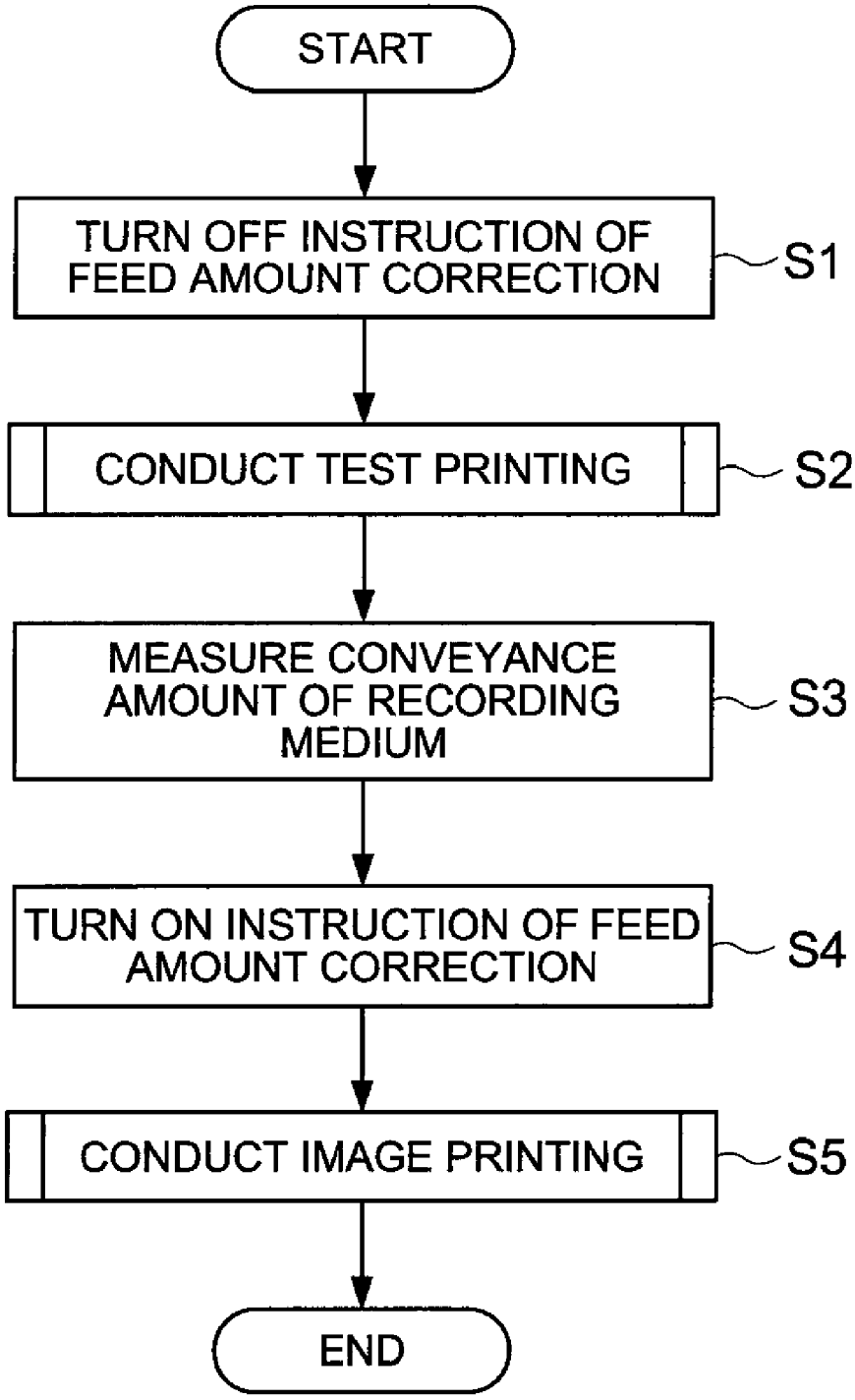

FIG. 7 is a flow chart of a method of feed amount correction for the conveyance belt.

Figure 8:
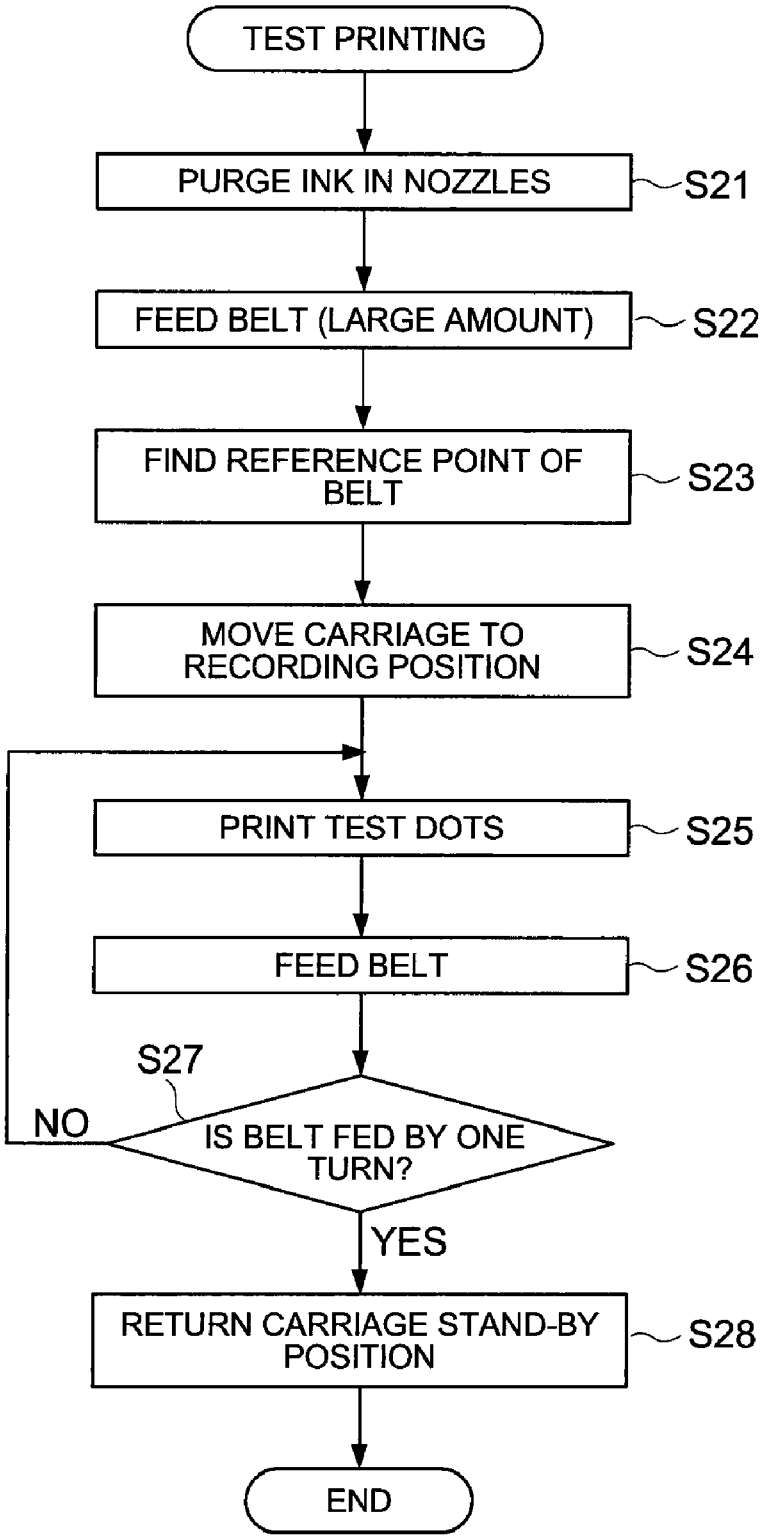

FIG. 8 is a flow chart of a method of feed amount correction for the conveyance belt.

Figure 9:
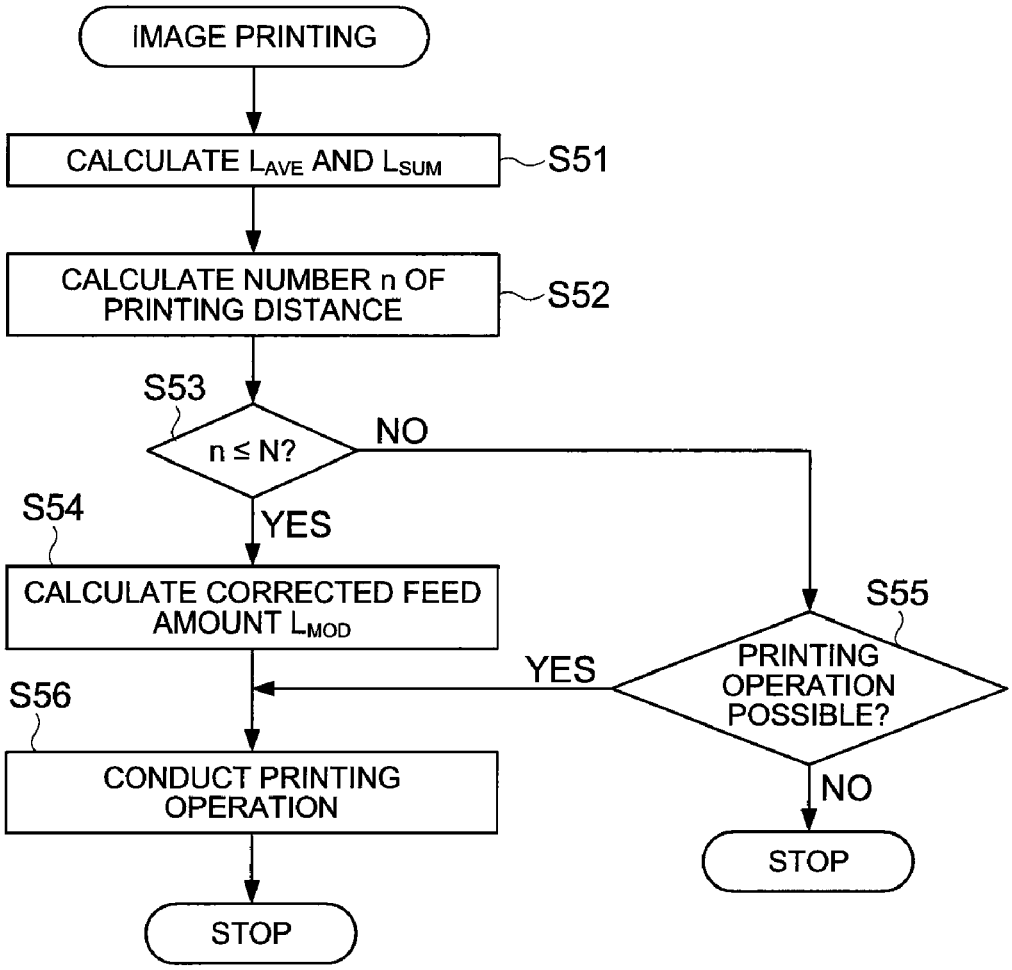

FIG. 9 is a flow chart of a method of feed amount correction for the conveyance belt.

Figure 10A:
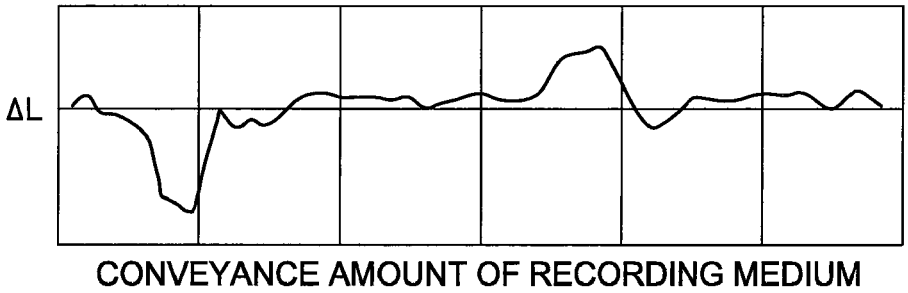
Figure 10B:
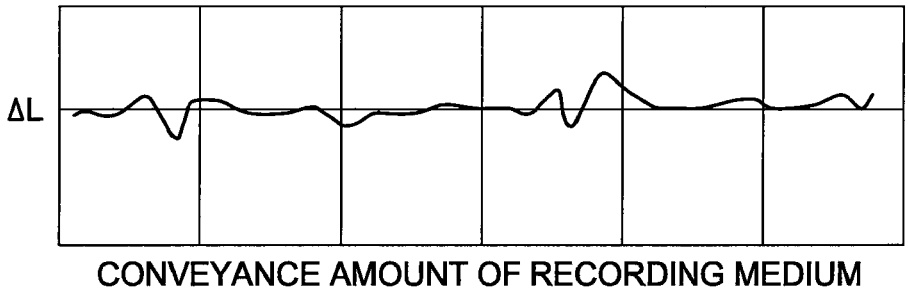

FIG. 10A is a graph showing an accuracy of conveyance before correction, and FIG. 10B is a graph showing an accuracy of conveyance after correction.

Figure 11:
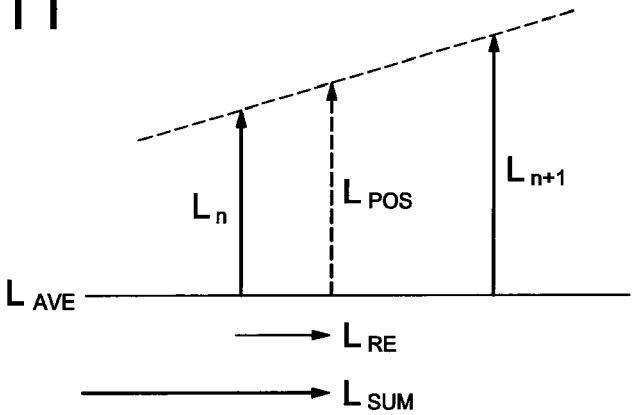

FIG. 11 is a conceptual diagram for calculation of a correction value.

DETAILED DESCRIPTION OF THE PREFERRED EMBODIMENT

An embodiment of the invention will be explained as follows, referring to the drawings.

Figure 1:
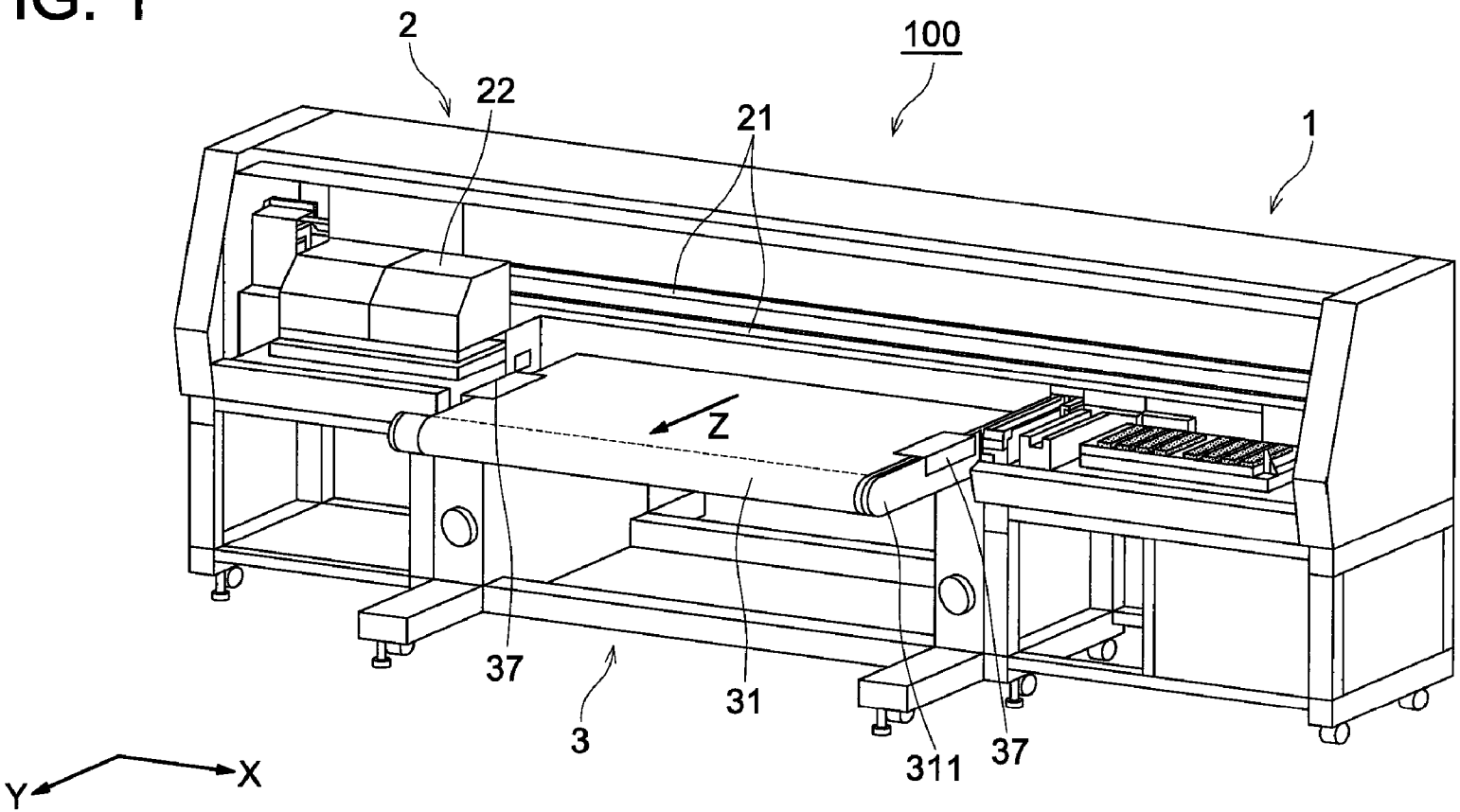
FIG. 1 is a perspective view of the inkjet recording apparatus relating to the invention.

FIG. 1 is a perspective view of inkjet recording apparatus 100 relating to the invention.

As is shown in this diagram, the inlet recording apparatus 100 is equipped with printer main body 1, control PC 4 and with test dots measuring section 5 (see FIG. 6). Among these items, the printer main body 1 is equipped with main scanning section 2, conveyance section 3 and printer section 6 (see FIG. 6).

Among these items, the main scanning section 2 and the conveyance section 3 will be explained first.

The main scanning section 2 is provided to be straddling the conveyance section 3, and inside of the main scanning section 2, there are provided cylindrical guide rails 21 and 21 which are extended in the direction of arrow X (hereinafter referred to as main scanning direction X) above the conveyance section 3. On these guide rails 21 and 21, carriage 22 that is mostly in a shape of a casing is supported to be capable of reciprocating freely in main scanning direction X.

Figure 2A:
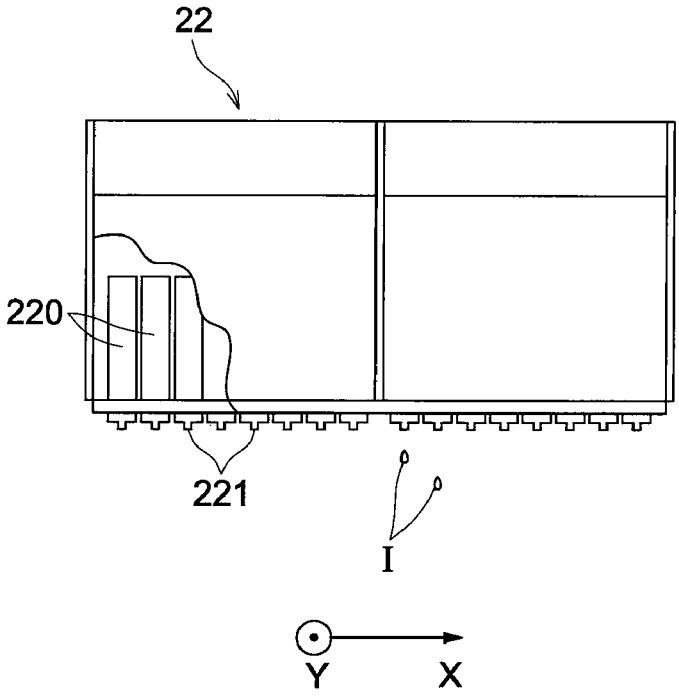
FIG. 2A is a front elevation of a carriage.
Figure 2B:
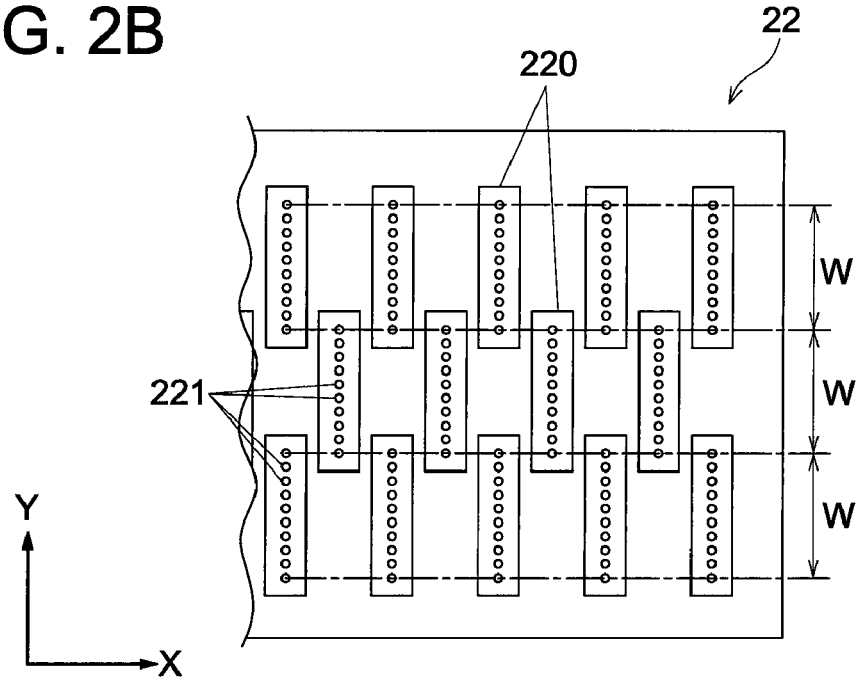
FIG. 2B is a bottom view.

FIG. 2A is a front elevation of carriage 22 and FIG. 2B is a bottom view of carriage 22.

On the carriage 22, there are mounted a plurality of recording heads 220 as shown in FIG. 2A and FIG. 2B, and in the present embodiment, there are mounted total 24 recording heads in total (8 colors×3 sets) wherein a row of only one set and a row having two sets arranged in the direction of arrow Y (hereinafter referred to as sub-scanning direction Y) are arranged reciprocally in the main scanning direction X to be in quantity of 16 rows. A bottom surface of the recording head 220 is exposed from carriage 22, and on the bottom surface, plural nozzles 221 each breaking out ink droplet I for each color of yellow (Y), magenta M, cyan (C) and black (K) are arranged in the sub-scanning direction Y.

Further, head driver 222 (see FIG. 6) that drives each recording head 220 for causing ink droplet I to jet from nozzle 221 is mounted on carriage 22, and carriage motor 23 (see FIG. 6) that causes the carriage 22 to scan in the main scanning direction X is connected to the carriage 22.

As shown in FIG. 1, endless conveyance belt 31 that conveys the recording medium in the direction of arrow Z (hereinafter referred to as feeding direction Z) by its feeding while supporting the unillustrated recording medium from the rear side, is arranged on the upper portion of the conveyance section 3. On both ends of the conveyance belt 31 in the main scanning direction, there are provided side plates 311. As a recording medium, it is possible to use a resin film and metals, in addition to a sheet and cloth, and there is no limitation in particular.

Figure 3:
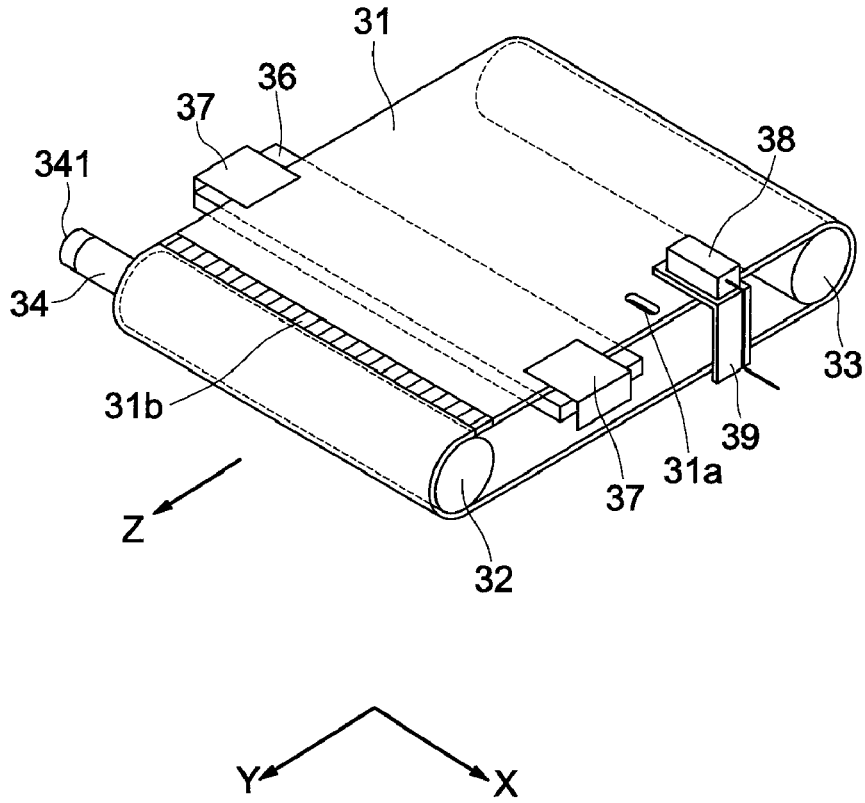
FIG. 3 is a perspective view showing the surroundings of the conveyance belt in a conveyance section.
Figure 4:
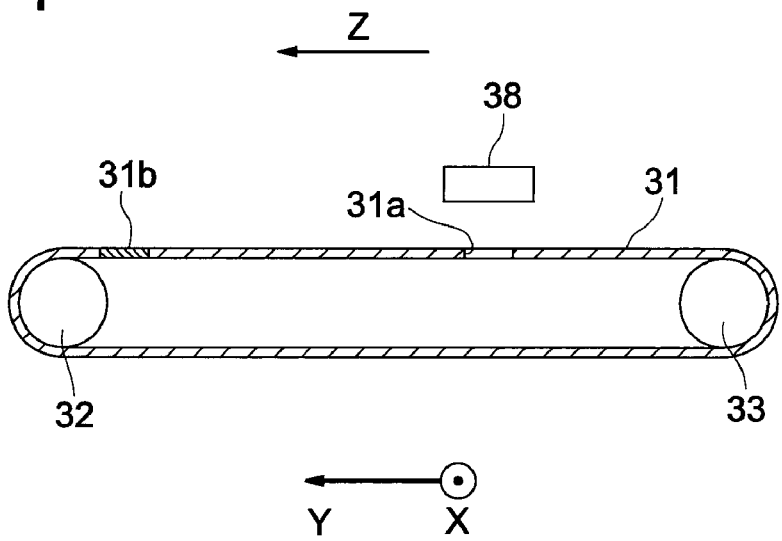
FIG. 4 is a diagram for illustrating a position of arrangement for a detection sensor.

FIG. 3 is a perspective view showing the surroundings of conveyance belt 31 in conveyance section 3. Incidentally, in FIG. 3, illustration of side plate 311 is omitted.

As is shown in FIG. 3, the conveyance belt 31 is trained about drive roller 32 and driven roller 33 in the feeding direction, and belt motor 34 for driving the drive roller 32 to rotate is connected to the side of one end of the chive roller 32 in the main scanning direction. The conveyance belt 31 is constructed so that it is sent in the feeding direction Z when the drive roller 32 is caused by the belt motor 34 to rotate. On the belt motor 34, there is fixed rotary encoder (hereinafter referred to as encoder) 341 that detects rotation phase of an unillustrated motor axis, and AC servo motor amplifier (hereinafter referred to as motor amplifier) 35 (see FIG. 6) that drives the belt motor 34 is connected to the belt motor 34. The encoder 341 is arranged to output encoder pulse corresponding to rotation phase of the detected motor axis to motor amplifier 35.

Further, on one end portion of the conveyance belt 31 in the main scanning direction X which does not support a recording medium, there is pierced hole 31*a* that stipulates a position (also referred to as a starting point) for feeding conveyance belt 31 in the feeding direction Z. In addition, on the conveyance belt 31, there is formed spliced portion 31*b* when the conveyance belt 31 is formed in an endless form to be extended in the main scanning direction X as a prescribed length, and in this spliced portion 31*b*, hardness and thickness are different from those on other portions.

Below the upper portion of conveyance belt 31, there is arranged platen 36 in a shape of a rectangular plate that is extended in the main scanning direction X, and on both ends of platen 36 in the main scanning direction X, there are arranged holding plates 37 for preventing violent behavior of the conveyance belt 31. These platen 36 and holding plate 37 are arranged so that carriage 22 may scan the upper portion of the platen 36 and the holding plate 37.

On the portion that is over the conveyance belt 31 and is on the one end side of the conveyance belt, detection sensor 38 for detecting hole 31*a* of the conveyance belt is fixed on the side plate 311 through sensor clamping plate 39 (see FIGS. 5A and 5B). Specifically, a position for arrangement of detection sensor 38 in the main scanning direction X is a position through which the hole 31*a* passes the lower portion in the case of feeding of the conveyance belt 31. Further, a position of arrangement of detection sensor 38 in the sub-scanning direction Y is a position where the hole 31*a* can be detected when the spliced portion 31*b* of the conveyance belt 31 is in the vicinity of drive roller 32 and is at the upstream side of the drive roller 32 in the feeding direction Z, in other words, when the spliced portion 31*b* is entering the drive roller 32 when the conveyance belt 31 is advanced. However, a position of arrangement of detection sensor 38 in the sub-scanning direction Y may also be a position where the hole 31*a* can be detected, when the spliced portion 31*b* is in the vicinity of driven roller 33 in place of the drive roller 32 and is at the upstream side of the driven roller 33 in the feeding direction Z.

Further, the detection sensor 38 is an optical sensor of a reflection type and it irradiates rays of light for detection downward in detecting operations. Therefor, the detection sensor 38 detects reflection of the rays of light for detection when a portion of conveyance belt 31 other than the hole 31*a* is positioned to be in the lower part as is shown in FIG. 5A, while, the detection sensor 38 cannot detect reflection of the rays of light for detection when the hole 31*a* is positioned to be in the lower part as is shown in FIG. 5B. In other words, the detection sensor 38 is arranged to be capable of detecting that the hole 31*a* is positioned to be in a lower part, as an occasion to be impossible to detect reflection of the rays of light for detection. Then, when the detection sensor 38 detects the hole 31*a*, the detection signals are outputted to interruption controller 66 (see FIG. 6) which will be explained later.

Further, the conveyance belt 31 is connected to belt regular rotation switch 71 and to belt reverse rotation switch 72 (see FIG. 6), and a user can advance the conveyance belt 31 manually in the regular direction (feeding direction Z) or in the reverse direction (direction opposite to the feeding direction Z), by pressing down the belt regular rotation switch 71 or the belt reverse rotation switch 72.

Next, a structure of control for the inkjet recording apparatus 100 will be explained as follows referring to FIG. 6. FIG. 6 is a block diagram showing the structure of control for the inkjet recording apparatus 100.

As is shown in the drawing, the inkjet recording apparatus 100 is equipped with control PC4, test dots measuring section 5 and with printer control section 6.

Among them, the control PC4 is an operation device through which a user operates the inkjet recording apparatus 100, and the printer control section 6 is controlled based on contents of the operations. In a concrete form, the control PC4 outputs control command and image data of printing image. As this control command, there are a command of correction for feeding amount which will be explained later and a command of test printing for confirming an accuracy of conveyance for the conveyance belt 31. In addition, the control PC4 is constructed so that results of measurement for printing spaces of test dots may be inputted from test dots measuring section 5 to be outputted to printer control section 6.

Concerning test dots to be explained later which are printed when a command of test printing is outputted to printer control section 6 from the control PC4, the test dots measuring section 5 measures printing spaces in the feeding direction Z, and outputs the results of the measurement to the control PC4. For the test dots measuring section 5 of this kind, heretofore known measuring instruments such as a scanner and a measuring microscope can be used. However, when a scanner is used, it is preferable to use one having a high resolution that is, for example, 2400 dpi (dot per inch) or higher.

The printer control section 6 is one to control respective sections of the printer main body 1, and it is equipped with total control section 60, image data processing section 61, carriage control section 62 and with conveyance control section 63.

Among the aforesaid items, the total control section 60 receives control commands coming from the control PC4, and controls image data processing section 61, carriage control section 62 and conveyance control section 63. In addition, the total control section 60 stores printing spaces for test dots outputted from the control PC4 in memory for measured values 68.

The image data processing section 61 is controlled by the total control section 60 to store image data inputted from the control PC4 in image memory 69, then, to process the image data to generate ink jetted data. And it outputs the ink jetted data thus generated to head driver 222 of carriage 22. The head driver 222 in which the ink jetted data have been inputted causes a droplet of ink I to jet from each of nozzles 221 of each recording head 220 based on the ink jetted data.

The carriage control section 62 is controlled by the total control section 60 to control driving of carriage motor 23 of carriage 22.

The conveyance control section 63 is one that is controlled by the total control section 60 to control feeding of the conveyance belt 31, and it is equipped with belt control section 64, pulse generator 65, interruption controller 66 and with belt position memory 67.

The belt control section 64 outputs drive signals for feeding the conveyance belt 31 at a certain feeding amount to the pulse generator 65, and reads out an encoder count which was calculated by pulse generator 65 and will be explained later, to detect a feeding amount for the conveyance belt 31. Further, when interruption signals coming from the interruption controller 66 explained later are inputted, the belt control section 64 outputs reset signals for resetting the encoder count to the pulse generator 65. The belt control section 64 calculates a total feeding amount of the conveyance belt 31 from detection of hole 31*a*, namely, a feeding position of the conveyance belt 31 whose reference is hole 31*a*, by calculating the total sum of feeding amount in drive signals after inputting of interruption signals coming from interruption controller 66, and outputs the calculated position in belt position memory 67. However, when the conveyance belt 31 is fed manually by the belt regular rotation switch 71 or the belt reverse rotation switch 72, feeding position of the conveyance belt 31 whose reference is hole 31*a* is calculated by an encoder count after input of interruption signals.

Further, the belt control section 64 is connected to the belt regular rotation switch 71 and to the belt reverse rotation switch 72, and it keeps outputting drive signals for the feeding amount established in advance to the pulse generator 65 during the period when the belt regular rotation switch 71 or the belt reverse rotation switch 72 is pressed down.

The pulse generator 65 receives drive signals coming from the belt control section 64, and generates chive pulses corresponding to the feeding amount of the conveyance belt 31 in this chive signals, to output them to motor amplifier 35, and to count encoder pulses from encoder 341 inputted through motor amplifier 35 as an encoder count. Meanwhile, in the present embodiment, one pulse of each of drive pulses and encoder pulses corresponds to a feeding amount of conveyance belt 31 of about 0.6 μm.

When detection signals from detection sensor 38 are inputted in interruption controller 66, the interruption controller 66 outputs interruption signals to belt control section 64.

The belt position memory 67 stores a feeding position for the conveyance belt 31 on which a reference is hole 31*a* inputted from the belt control section 64.

Next, a correction method of feeding amount of conveyance belt 31 will be explained as follows, referring mainly to FIGS. 7 to 9.

Each of FIGS. 7 to 9 is a flow chart of a correction method of feeding amount of conveyance belt 31.

First, as shown in FIG. 7, a user operates the control PC4 to turn off an instruction of feed amount correction (step S1). This instruction of feed amount correction is a control command for feeding the conveyance belt 31 at a corrected feed amount $L_{MOD}$ which will be explained later.

Next, test printing is conducted for confirming an accuracy of conveyance for the conveyance belt 31 (step S2). This test printing is carried out when a user operates the control PC4 to cause an instruction of test printing to be outputted. Incidentally, when a state of jetting of ink droplet I from plural nozzles 221 is not excellent, it is preferable to conduct cleaning of plural recording heads 220 in advance.

After this test printing has been carried out, printer control section 6 controls first head driver 222 to conduct a purge of ink in nozzle 221 for improving jetting properties, as shown in FIG. 8 (step S21). In this case, ink droplets I in quantity of about 150 shots are caused to jet from nozzle 221.

Next, the printer control section 6 drives belt motor 34 to convey a recording medium by feeding the conveyance belt 31 by a feeding amount that is double the pitch $L_{COM}$ for the prescribed feeding amount which will be explained later (step S22).

Incidentally, a nozzle purge and belt feeding in step S21 and step S22 do not need to be conducted, if there is no problem in jetting properties for ink droplets I from a plurality of nozzles 221.

Next, there is conducted the finding of reference point of conveyance belt 31 (step S23). In this case, the printer control section 6 drives belt motor 34 to keep feeding the conveyance belt 31 in the feeding direction until the moment when the hole 31*a* is detected by detection sensor 38. Then, when the hole 31*a* is detected, the printer control section 6 causes the conveyance belt 31 to stop, and resets the encoder count counted by pulse generator 65. Further, the printer control section 6 establishes a position on a recording medium on which test dots are printed in the following step as an origin in the feeding direction Z for the test dots printed intermittently in the feeding direction Z.

Meanwhile, the finding of reference point for the conveyance belt 31 in the step S23 may also be conducted before a nozzle purge and belt feeding in steps S21 and S22. However, in that case, it is preferable to make the origin established on the recording medium to remain unchanged, by putting the conveyance belt 31 back in the direction opposite to the feeding direction Z by a feeding amount that is double the pitch $L_{COM}$ for the prescribed feeding amount fed in the feeding direction Z in step S22.

Next, the printer control section 6 drives carriage motor 23 to cause carriage 22 to move to a recording position (step S24). This recording position has only to be above the recording medium that is set on the conveyance belt 31 in advance. Incidentally, the recording medium used in this case can be anything provided that it is one in at least a length equivalent to one round of the conveyance belt 31 in the feeding direction, and it is preferable that the recording medium used in this case is a sheet of paper.

Next, the printer control section 6 controls head driver 222 to cause ink droplets I to jet from plural nozzles 221, and causes test dots to be printed on the recording medium n (step S25). In this case, ink droplets I in quantity of 15 shots are caused to jet as test dots.

Next, the printer control section 6 drives belt motor 34 to feed the conveyance belt 31 by a length of a pitch $L_{COM}$ for the prescribed feeding amount in the feeding direction Z, to cause the recording medium to be conveyed (step S26). In this case, pitch $L_{COM}$ for prescribed feeding amount is a typical feeding amount selected in advance among plural feeding amounts of the conveyance belt 31. This pitch $L_{COM}$ for prescribed feeding amount is 54.1867 mm in the present embodiment, and it is set as follows.

Since nozzles 221 in quantity of 512 per head are arranged at 180 npi (nozzle per inch) in the sub-scanning direction Yin recording head 220, length W of this nozzle row in the sub-scanning direction Y is 25.4/180×512 which is nearly equal to 72.2489 mm (see FIG. 2B). Further, three recording heads 220 per one color are provided so that each row does not overlap in the sub-scanning direction. Y, thus, the total length of the nozzle rows in these three recording heads 220 is 722489×3=216.7467 mm. For conducting printing by these recording heads 220 at 720 dpi in sub-scanning direction Y (feeding direction Z) as a typical printing mode in the inkjet recording apparatus 100 in the present embodiment, feeding operations in 720/180=4 times are needed. Therefore, for realizing this operation with even feeding of the conveyance belt 31, it is necessary to make a pitch of feeding amount to be 216.7467/4=54.1867 mm.

Next, the printer control section 6 judges whether the total feeding amount of the conveyance belt 31 from the origin on the recording medium established in step 23 arrives at a length equivalent to one round of the conveyance belt 31 in the feeding direction Z or not (step S27), and when the total feeding amount has not arrived (step S27; No), a flow returns to step S25 to repeat printing operations of test dots.

Further, when the total feeding amount of the conveyance belt 31 from the origin on the recording medium has not arrived at a length equivalent to one round of the conveyance belt 31 in the feeding direction Z in step S27 (step S27; Yes), the printer control section 6 drives carriage motor 23 to cause carriage 22 to move to the prescribed position for standing by (step S28), and test printing is terminated. In the present embodiment, since a length equivalent to one round of the conveyance belt 31 in the feeding direction Z is about 2980 mm, the total number N of test dots in the feeding direction Z is 2980/54.1867 which is nearly equal to 55 points, excluding on point at the origin.

After termination of test printing, a space of printing for test dots, namely, actual amount of conveyance for the recording medium is measured by test dot measuring section 5, as shown in FIG. 7 (step S3). Then, the space of printing for test dots thus measured is read into control PC4 to be outputted to printer control section 6, and is stored in memory for measured values 68.

When difference ΔL between each printing space of measured test dots and pitch $L_{COM}$ which represents a command value of the space of printing for test dots for the prescribed feeding amount is represented graphically concerning an amount of conveyance of the recording medium, it becomes like one shown in FIG. 10A. From this graph, it is understood that, when spliced section 31*b* of the conveyance belt 31 touches drive roller 32 or drive roller 33, ΔL grows greater, namely, an accuracy of conveyance is lowered. This is caused by that hardness and a thickness of the spliced section 31*b* are different from those of the other portion of the conveyance belt 31.

After the space of printing of test dots is measured in step S3, printer control section 6 makes the correction of feeding amount to be effective (step S4). In other words, the printer control section 6 establishes to feed the conveyance belt 31 by the corrected feeding amount which will be explained later.

Next, the printer control section 6 conducts image printing (step S5). In this case, the printer control section 6 corrects a feeding amount of the conveyance belt 31 to the corrected feeding amount corresponding to the position of feeding for the conveyance belt 31 based on the results of measurement of test dots measured in step S3 (correction process), then, it controls head driver 222 to cause ink droplet I to jet recording medium from nozzle 221 of recording head 220 while feeding the conveyance belt 31 in the corrected feeding amount by driving belt motor 34, thus, inputted image data are printed (ordinary printing process).

In this image printing, the printer control section 6 first calculates mean value $L_{AVE}$ of the measured spaces of printing for one round of the conveyance belt 31 and total amount of conveyance $L_{SUM}$ of a recording medium from the origin to the position of feeding for the conveyance belt 31 to be calculated (step S51). The position of feeding for the conveyance belt 31 in this case means a position of the conveyance belt 31 on which optional test dots are printed. Further, the total amount of conveyance $L_{SUM}$ is calculated as $L_{SUM}=i\times L_{COM}$ (where, i=1 to N) in the case of $i^{th}$ test dot from the origin, for example, by using pitch $L_{COM}$ for the prescribed feeding amount.

Next, the printer control section 6 calculates, by using the following expression (1), the ordinal number n of the space of printing for test dots in the direction opposite to the feeding direction Z from the origin (step S52).

$$n=int(L_{SUM}/L_{AVE}) \quad (1)$$

In the expression above, int A is an integer that does not exceed A.

Next, the printer control section 6 judges whether the ordinal number n calculated in step S52 is smaller than the total number of test dots or not (step S53), and if the number n is smaller than the total number N (step S53; Yes), the printer control section 6 calculates corrected feeding amount $L_{MOD}$ representing corrected pitch $L_{COM}$ for the prescribed feeding amount with the following expressions (2) to (4), by using measured $n^{th}$ printing space $L_n$ and $(n+1)^{th}$ printing space $L_{n+1}$ (step S54)

$$L_{RE}=L_{SUM} \bmod L_{AVE} \quad (2)$$

$$L_{POS}=L_n+L_{RE}\times\{(L_{n+1}-L_n)/L_{AVE}\} \quad (3)$$

$$L_{MOD}=L_{COM}\times L_{AVE}/L_{POS} \quad (4)$$

In the expressions above, AmodB is a residue of A/B.

The aforesaid calculation of corrected feeding amount $L_{MOD}$ by the expressions (1) to (4) will be explained.

First, in expression (1), with respect to optional total amount of conveyance $L_{SUM}$ from the origin, the nearest one among test dots through which the $L_{SUM}$ passed is calculated to be n. Then, in expression (2), a length by which the $L_{SUM}$ exceeds an amount of conveyance up to $n^{th}$ test dot is calculated as $L_{RE}$. Next, in expression (3), imaginary feeding amount $L_{POS}$ at the position that is apart from $L_n$ by $L_{RE}$ is calculated by interpolating $L_n$ and $L_{n+1}$ linearly. Finally, corrected feeding amount $L_{MOD}$ is calculated from $L_{POS}$ by expression (4). A conceptual diagram for the above calculation is shown in FIG. 11. An example of the results of calculation is shown in the following Table 1.

TABLE 1

| n | $L_{COM}$ [mm] | $L_N$ [mm] | $L_{AVE}$ [mm] | $L_N - L_{AVE}$ [mm] | $L_{MOD}$ [mm] | $L_{MOD} - L_{COM}$ [mm] |
|---|---|---|---|---|---|---|
| 1 | 54.1867 | 54.3502 | 54.3384 | 0.0118 | 54.1749 | −0.0118 |
| 2 | 54.1867 | 54.3805 | | 0.0421 | 54.1448 | −0.0419 |
| 3 | 54.1867 | 54.3592 | | 0.0208 | 54.1660 | −0.0207 |
| 4 | 54.1867 | 54.3513 | | 0.0129 | 54.1738 | −0.0129 |
| . | . | . | | . | . | . |
| . | . | . | | . | . | . |
| . | . | . | | . | . | . |

Further, in step S54, the printer control section 6 predicts corrected feeding amount $L'_{MOD}$ about another feeding amount $L'_{COM}$ other than pitch for the prescribed feeding amount $L_{COM}$, based on results of measurement for printing space for test dots printed at pitch $L_{COM}$ for the prescribed feeding amount.

Specifically, when a value of feeding amount $L'_{COM}$ is smaller than pitch $L_{COM}$ for the prescribed feeding amount, $L'_{MOD}$ is calculated by the following expression (5) that uses $L'_{COM}$ in place of $L_{COM}$ in the expression (4).

$$L'_{MOD}=L'_{COM}\times L_{AVE}/L_{POS} \quad (5)$$

On the other hand, when feeding amount $L'_{COM}$ takes a value that exceeds pitch $L_{COM}$ for the prescribed feeding amount, $L'_{MOD}$ is calculated by the following expressions (6) to (9), after $L'_{SUM}=i\times L'_{COM}$ (where, i=1 to $N\times L_{COM}/L'_{COM}$) is calculated concerning test dots from the origin to $i^{th}$ test dot to be calculated.

$$n' = \mathrm{int}(L'\mathrm{sum}/L_{AVE}) \quad (6)$$

$$L'_{RE} = L'_{SUM} \bmod L_{AVE} \quad (7)$$

[Numeral 1]

$$L'_{POS} = \sum_{m=n}^{n'} L_m - L'_{RE} \times \frac{L'_{n+1} - L'_n}{L_{AVE}} \quad (8)$$

$$L'_{MOD} = L'_{COM} \times L'_{COM} / L'_{POS} \quad (9)$$

When the number n calculated in step S52 exceeds the total number N of test dots in step S53 (step S53; No), the printer control section 6 judges whether printing operations are possible or not (step S55). In this case, there is a fear that belt motor 34, detection sensor 38 or conveyance control section 63 is problematic, or mechanical portions are abnormal, or the conveyance belt 31 is slipping. Therefore, the printing operations are confirmed whether they are possible or not, and when they are judged to be possible (step S55; Yes), the printer control section 6 moves to step S56 to conduct printing operations without correcting a feeding amount of the conveyance belt 31. On the other hand, when the printing operations are judged to be impossible (step S55; No), the printer control section 6 indicates errors to a user, and stops operations of the inkjet recording apparatus 100.

When corrected feeding amount $L_{MOD}$ is calculated in step S54, the printer control section 6 conducts desired printing by causing ink droplets I to jet from nozzle 221 of recording head 220, while feeding the conveyance belt 31 by using corrected feeding amount $L_{MOD}$ in place of pitch $L_{COM}$ for the prescribed feeding amount $L_{COM}$ (step S56). However, when feeding the conveyance belt 31 with another feeding amount $L'_{COM}$ other than pitch $L_{COM}$ for prescribed feeding amount, the printer control section 6 conducts printing while feeding the conveyance belt 31 by using corrected feeding amount $L'_{MOD}$ in place of another feeding amount $L'_{COM}$.

With respect to calculation or judgment in the aforesaid steps S51 to S54, it is carried out each time feeding of the conveyance belt 31 is instructed as driving signals from belt control section 64, for an amount of the feeding. In other words, the printer control section 6 conducts printing in step S56, while calculating the corrected feeding amount for each feeding of the conveyance belt 31.

By conducting printing by using corrected feeding amount $L_{MOD}$ as stated above, a feeding amount is corrected based on an amount of conveyance for a recording medium corresponding to a position of feeding of the conveyance belt 31.

Therefore, as is shown in FIG. 10B, it is possible to control a decline of an accuracy of conveyance in the case where the spliced portion 31*b* of the conveyance belt 31 touches drive roller 32 or driven roller 33, compared with FIG. 10A before the correction.

In the printing that employs this corrected feeding amount, the printer control section 6 causes starting point hole 31*a* to be detected by detection sensor 38, and resets a position of feeding conveyance belt 31 calculated by belt control section 64, for each detection of the starting point hole 31*a* following the feeding of the conveyance belt 31. Then, the printer control section 6 controls conveyance control section 63 so that the conveyance belt 31 may be fed with a corrected amount of conveyance that corresponds to the new position of feeding the conveyance belt 31 that is sent after the resetting.

Further, in the printing that employs this corrected feeding amount, the position of feeding the conveyance belt 31 calculated by the belt control section 64 is stored in belt position memory 67. Therefore, even when the conveyance belt 31 is fed manually by belt regular rotation switch 71 or belt reverse rotation switch 72, the feeding position does not become unclear, and a feeding amount can be controlled properly.

In the correction method of feeding amount for conveyance belt 31 in the present embodiment, the feeding amount is connected based on an amount of conveyance of a recording medium corresponding to the position of feeding for the conveyance belt 31 as is stated above. Therefore, it is possible to control a decline of an accuracy of conveyance in the case where the spliced portion 31*b* of the conveyance belt 31 touches drive roller 32 or driven roller 33. Namely, it is possible to control fluctuations of a feeding amount caused by distribution of hardness and a thickness which are peculiar to the conveyance belt 31.

Further, the starting point hole 31*a* of the conveyance belt 31 is detected when spliced portion 31*b* of the conveyance belt 31 is in the vicinity of drive roller 32 or driven roller 33 and it is at the upstream side of the drive roller 32 or of driven roller 33 in the feeding direction Z. Therefore, the spliced portion 31*b* touches either one of the rollers immediately after the starting point hole 31*a* is detected. In other words, the spliced portion 31*b* touches either one of the rollers immediately after the printing of test dots is started. Therefore, entering of the spliced portion 31*b* into either one of the rollers that causes greatest changes for the worse for accuracy of conveyance can be conducted in the initial stage of test printing where accumulation of errors is less. Accordingly, printing spaces at a position where the greatest change for the worse is caused can be measured at higher accuracy, resulting in possibility of correction at higher accuracy.

Further, since the starting point hole 31*a* is arranged on a portion that is one end portion of the conveyance belt 31 in the main scanning direction X and does not support a recording medium, no harmful influence is exerted on printing operations on the recording medium. Further, since the starting point hole 31*a* is a hole portion, there is no possibility of erroneous detection caused by adhesion of ink droplet I and by sliding of a marker itself, and it can be formed at low cost, which is different from an occasion where a marker is pasted on a surface of the conveyance belt 31.

It is further possible to control accumulated errors for the feeding amount caused by microscopic slip of the conveyance belt 31, because a position of feeding for the conveyance belt 31 is reset for each detection of the starting point hole 31*a*.

Further, since the position of feeding the conveyance belt 31 having a reference of starting point hole 31*a* is stored, even when the conveyance belt 31 is fed manually by belt regular rotation switch 71 or by belt reverse rotation switch 72, the feeding position does not become unclear, and a feeding amount can be controlled properly.

In addition, pitch for the prescribed feeding amount $L_{COM}$ is a typical feeding amount selected in advance among plural feeding amounts of the conveyance belt 31, and corrected feeding amount about another feeding amount other than the typical feeding amount is predicted based on results of measurement for printing space of test dots printed with the typical feeding amount. Thus, it is possible to correct highly accurately the feeding amount that is used at the highest frequency, for example, as a typical feeding amount, and it is possible to obtain plural corrected feeding amounts easily without necessity of conducting correction of feeding amount for all of the plural feeding amounts.

Meanwhile, the invention should not be construed to be limited to the aforesaid embodiment, and the embodiment can naturally be varied and improved.

For example, in the aforesaid embodiment, the spliced portion 31*b* of the conveyance belt 31 has been described to be one formed to be extended in the main scanning direction X. However, the spliced portion 31*b* may also be one formed to be oblique relative to the main scanning direction X. However, in the case of conveyance belt 31 that has the oblique spliced portion 31*b* of this kind and has a thickness exceeding the prescribed value, aggravation of an accuracy of conveyance caused by spliced portion 31*b* touching either one of the rollers becomes inconstant, resulting in a fear that an inhibition of this problem by control is difficult, which is not preferable.

Though a feeding amount for the conveyance belt 31 can be measured by using a contact sensor such as, for example, an encoder, when a surface of the conveyance belt 31 is caused to be a surface to be measured, there is a fear that adhesives for sticking a recording medium adhere to the sensor to cause erroneous operations, while, when the reverse side is caused to be a surface to be measured, there are fears including a fear that the aforesaid adhesives run over to the reverse side and a fear that erroneous operations are caused by scattered ink droplets I, which is not preferable.

Further, the detection sensor 38 may also be of a transmission type without being of a reflection type, but in the case of a sensor of a transmission type, there is a fear that smudges adhere to a light-emitting device or a light-receiving device to cause erroneous detection, which is not preferable.

Further, in image printing in the correction method of a feeding amount for the conveyance belt 31, a calculation of the corrected feeding amount is not always needed for each feeding of the conveyance belt 31, and corrected feeding amounts for all printing spaces can be calculated collectively.

In the embodiment of the invention, test dots are printed on a recording medium with a pitch for the prescribed feeding amount from the origin established on the recording medium based on the starting point on the conveyance belt, and the feeding amount for the conveyance belt is corrected to the corrected feeding amount corresponding to the position of feeding of the conveyance belt, based on results of the measurement of printing space of the aforesaid test dots. In other words, it is possible to control fluctuations of feeding amount caused by distribution of hardness and a thickness which are peculiar to the conveyance belt, because the feeding amount is corrected based on an amount of conveyance for the recording medium corresponding to the position of feeding for the conveyance belt.

In another embodiment, the starting point of the conveyance belt is detected when a spliced portion of the conveyance belt is in the vicinity of a drive roller and is at the upstream side of the roller in the feeding direction, therefore, the spliced portion touches the roller immediately after the starting point is detected. In other words, the spliced portion touches the roller immediately after the start of printing of test dots, therefore, entering of the spliced portion into the roller that causes greatest changes for the worse for accuracy of conveyance can be conducted in the initial stage of test printing where accumulation of errors is less. Accordingly, printing spaces at a position where the greatest change for the worse is caused can be measured at higher accuracy, resulting in possibility of correction at higher accuracy.

In further another embodiment, the starting point is arranged on a portion that is an end portion of the conveyance belt in its width direction and does not support a recording medium, therefore, no harmful influence is exerted on printing operations on the recording medium. Further, since the starting point is a hole portion, there is no possibility of erroneous detection caused by adhesion of ink droplets and by sliding of a marker itself, and it can be formed at low cost, which is different from an occasion where the marker is pasted on a surface of the conveyance belt.

In still another embodiment, it is possible to control accumulated errors for the feeding amount caused by microscopic slip of the conveyance belt, because a position of feeding for the conveyance belt is reset for each detection of the starting point.

In still another embodiment, even when the conveyance belt is fed manually, for example, the feeding position does not become unclear, and a feeding amount can be controlled properly, because the position of feeding the conveyance belt having a reference of starting point is stored.

In still another embodiment, a pitch for the prescribed feeding amount is a typical feeding amount selected in advance among plural feeding amounts of the conveyance belt, and corrected feeding amount about another feeding amount other than the typical feeding amount is predicted based on the corrected feeding amount obtained through correction of the typical feeding amount, thereby, it is possible to correct highly accurately the feeding amount that is used at the highest frequency, for example, as a typical feeding amount, and it is possible to obtain plural corrected feeding amounts easily without necessity of conducting correction of feeding amount for all of the plural feeding amounts.

What is claimed is:

1. A feeding amount correction method of an endless conveyance belt in an inkjet recording apparatus that jets an ink droplet to a recording medium from an inkjet head while conveying the recording medium supported on the conveyance belt by feeding the conveyance belt for conducting printing, the feeding amount correction method comprising the steps of:

(a) printing test dots of an amount equivalent to one round of the conveyance belt at a pitch of a prescribed feeding amount, from an origin on the recording medium to be established when a starting point arranged on the conveyance belt is detected, while causing the conveyance belt to convey the recording medium in a feeding direction of the conveyance belt at the pitch of the prescribed feeding amount;

(b) measuring a conveyance amount that measures a printing space between the test dots printed in the step of printing test dots;

(c) correcting a feeding amount of the conveyance belt to a corrected feeding amount corresponding to a feeding position of the conveyance belt, based on the measuring results in the measuring step; and (d) conducting an ordinary printing on the recording medium, while feeding the conveyance belt according to the corrected feeding amount that has been corrected in the correcting step.

2. The method of claim 1, wherein the conveyance belt has a spliced portion when forming the conveyance belt in an endless form, and is trained about plural rollers, the method further comprising:

detecting the starting point of the conveyance belt when the spliced portion of the conveyance belt is located in the vicinity of the rollers and upstream of the rollers in the feeding direction, and the step of printing test dots comprises establishing the position of the recording medium where the test dots are printed as the origin, when the starting point of the conveyance belt is detected.

3. The method of claim 1, wherein the starting point is a hole portion which is arranged in an end portion of the conveyance belt that does not support the recording medium.

4. The method of claim 1, wherein the step of correcting comprises the sequential steps of:

calculating an ordinal number n of the printing space between the test dots in a direction opposite to the feeding direction from the origin in the feeding position of the conveyance belt, according to the following expression (1) below; and calculating corrected feeding amount $L_{MOD}$ representing corrected pitch $L_{COM}$ which indicates a command value of the printing space, for the prescribed feeding amount, with the following expressions (2) to (4), by using measured $n^{th}$ printing space $L_n$ and $(n+1)^{th}$ printing space $L_{n+1}$, $$n=int(L_{SUM}/L_{AVE}) \quad (1)$$

$$L_{RE}=L_{SUM} \bmod L_{AV} \quad (2)$$

$$L_{POS}=L_n+L_{RE}\times\{(L_{n+1}-L_n)/L_{AVE}\} \quad (3)$$

$$L_{MOD}=L_{COM}\times L_{AVE}/L_{POS} \quad (4)$$

where n represents an integer that does not exceed $L_{SUM}/L_{AVE}$, $L_{SUM}$ represents a total amount of conveyance of the recording medium from the origin to the position of feeding for the conveyance belt to be calculated, $L_{AVE}$ represents a mean value of the measured spaces of printing for one round of the conveyance belt, and $L_{RE}$ represents a residue of $L_{SUM}/L_{AVE}$.

5. The method of claim 1, wherein the step of conducting ordinary printing comprises:

resetting the feeding position of the conveyance belt, for each detection of the starting point following the feeding of the conveyance belt; and then feeding the conveyance belt with the corrected feeding amount corresponding to a second feeding position of the conveyance belt that is fed after resetting.

6. The method of claim 1, wherein the step of conducting ordinary printing comprises:

storing the feeding position of the conveyance belt on which a reference is the starting point.

7. The method of claim 1, wherein the pitch for the prescribed feeding amount is a typical feeding amount selected in advance among plural feeding amounts of the conveyance belt, and the step of correcting comprises:

predicting a corrected feeding amount with respect to another feeding amount other than the typical feeding amount based on measurement results for the printing space of the test dots printed with the typical feeding amount.

8. An inkjet recording apparatus that prints by jetting an ink droplet to a recording medium from an inkjet head while causing an endless conveyance belt to convey the recording medium supported on the conveyance belt, the inkjet recording apparatus comprising:

(a) a control device that controls feeding of the conveyance belt so that the recording medium is conveyed at a pitch of a prescribed feeding amount in a feeding direction of the conveyance belt, and establishes an origin on the recording medium based on a detection of a starting point arranged on the conveyance belt, and controls driving of the inkjet head so that test dots of an amount equivalent to one round of the conveyance belt are printed on the recording medium at the pitch of the prescribed feeding amount, from the origin;

(b) an input device to which measurement results of a printing space between the test dots are inputted; and (c) a correction device that corrects the feeding amount of the conveyance belt to a corrected feeding amount corresponding to a feeding position of the conveyance belt based on the measurement results for the inputted printing space, wherein the control device causes an ink droplet to jet to the recording medium from the inkjet head while feeding the conveyance belt according to the corrected feeding amount corrected by the correction device.

9. The inkjet recording apparatus of claim 8, wherein the conveyance belt has a spliced portion when forming the conveyance belt in an endless form, and is trained about plural rollers, and the apparatus further comprising a detection sensor which detects the starting point of the conveyance belt when the spliced portion of the conveyance belt is located in the vicinity of the rollers and upstream of the rollers in the feeding direction, further the control device establishes the position of the recording medium where the test dots are printed as the origin, when the starting point of the conveyance belt is detected by the detection sensor.

10. The inkjet recording apparatus of claim 8, wherein the starting point is a hole portion which is arranged in an end portion of the conveyance belt that does not support the recording medium.

11. The inkjet recording apparatus of claim 8, wherein in the feeding position of the conveyance belt, the correction device calculates an ordinal number n of the printing space between the test dots in a direction opposite to the feeding direction from the origin according to the following expression (1) below, and then calculates corrected feeding amount $L_{MOD}$ representing corrected pitch $L_{COM}$ which indicates a command value of the printing space, for the prescribed feeding amount, with the following expressions (2) to (4), by using measured $n^{th}$ printing space $L_n$ and $(n+1)^{th}$ printing space $L_{n+1}$ of measured results of the printing space inputted by the input device, $$n=int(L_{SUM}/L_{AVE}) \quad (1)$$

$$L_{RE}=L_{SUM} \bmod L_{AV} \quad (2)$$

$$L_{POS}=L_n+L_{RE}\times\{(L_{n+1}-L_n)/L_{AVE}\} \quad (3)$$

$$L_{MOD}=L_{COM}\times L_{AVE}/L_{POS} \quad (4)$$

where n represents an integer that does not exceed $L_{SUM}/L_{AVE}$, $L_{SUM}$ represents a total amount of conveyance of the recording medium from the origin to the position of feeding for the conveyance belt to be calculated, $L_{AVE}$ represents a mean value of the measured spaces of printing for one round of the conveyance belt, and $L_{RE}$ represents a residue of $L_{SUM}/L_{AVE}$.

12. The inkjet recording apparatus of claim 8, wherein when the control device feeds the conveyance belt according to the corrected feeding amount, the control device resets the feeding position of the conveyance belt, for each detection of the starting point following the feeding of the conveyance belt, and then feeds the conveyance belt with the corrected feeding amount corresponding to a second feeding position of the conveyance belt that is fed after resetting.

13. The inkjet recording apparatus of claim 8, wherein when the control device feeds the conveyance belt according to the corrected feeding amount, the control device comprises a memory which stores the feeding position of the conveyance belt on which a reference is the starting point.

14. The inkjet recording apparatus of claim 8, wherein the pitch for the prescribed feeding amount is a typical feeding amount selected in advance among plural feeding amounts of the conveyance belt, and the correction device predicts a corrected feeding amount with respect to another feeding amount other than the typical feeding amount based on measurement results for the printing space of the test dots printed with the typical feeding amount.

* * * * *